United States Patent [19]

Inculet et al.

[11] Patent Number: 4,509,694

[45] Date of Patent: Apr. 9, 1985

[54] CROSS-CURRENT AIRFOIL ELECTROSTATIC NOZZLE

[75] Inventors: Ion I. Inculet; Kenneth J. Hodgson, both of London, Canada

[73] Assignee: Canadian Patents & Development Limited, Ottawa, Canada

[21] Appl. No.: 499,983

[22] Filed: Jun. 1, 1983

[51] Int. Cl.[3] ..... B05B 5/00

[52] U.S. Cl. ..... 239/697; 239/704; 239/DIG. 7

[58] Field of Search ..... 239/690, 692, 695, 696, 239/697, 704, 706, 708, 521, 522, 523, 590, 590.5, DIG. 7, 434, 707

[56] References Cited

U.S. PATENT DOCUMENTS

| | | | |
|---|---|---|---|
| 2,616,676 | 11/1952 | Walker | 239/523 X |
| 2,770,501 | 11/1956 | Coanda | 239/DIG. 7 |
| 2,907,557 | 10/1959 | Coanda | 239/DIG. 7 |
| 3,047,208 | 7/1962 | Coanda | 239/434 X |
| 3,893,628 | 7/1975 | McCollum | 239/521 |
| 4,347,984 | 9/1982 | Sickles | 239/707 |

*Primary Examiner*—Andres Kashnikow
*Assistant Examiner*—James R. Moon, Jr.
*Attorney, Agent, or Firm*—E. Rymek

[57] ABSTRACT

The electrostatic nozzle may be used to spray one or more charged clouds in different areas of an enclosed room to allow different materials to be deposited on different sections of the surfaces. The nozzle includes a conduit through which air passes over one or more airfoils to entrain a liquid across the surface. A charged electrode, facing the surface, inductively charges the liquid on the surface. The liquid is atomized at the trailing edge of the airfoil by a cross-current created by an air deflector near the trailing edge of the airfoil.

15 Claims, 6 Drawing Figures

A
A
0.775
0.75
1/16
1 1/8
0.4
3/16D
12°
3/8
9/16R
2.25
1.875
0.12
0.75
0.059
1/4
1/4
1/32D
9/16
2.3
0.25

CROSS-CURRENT AIRFOIL ELECTROSTATIC NOZZLE

BACKGROUND OF THE INVENTION

The invention is directed to electrostatic spraying, and in particular, to a nozzle for electrostatic spraying.

Dairy barns and other buildings where livestock are kept provide ideal breeding grounds for the common house fly. Very large populations of this pest can develop and thus, pose a sanitary problem. This necessitates the periodic spraying of these buildings to control the fly population with insecticides. For adequate fly control it has been found that the periodic application of residual pesticides is necessary.

At present, residual sprays are sprayed mechanically often by hand using a manually pressurized tank which is carried around the building during the application. This method of spraying insecticides in barns or other livestock operations has been often reported as ineffective or unsatisfactory, particularly for the hard to reach areas in barn ceilings where breeding centers for flies develop. The sprays or aerosols generated by means of hand or mechanically operated apparatus do not deposit easily on critical locations for the control of flies. For an adequate coverage of all areas, unnecessarily large amounts of pesticides may have to be used.

With the large amount of pesticide which must be used, the farmer may be exposed to the pesticide he is spraying and the animals in the barn may be exposed to insecticide which drips into the bedding or feed. If the coverage is inadequate in some areas however, it may allow resistance to the insecticide to build up in fly populations.

It is well known, as documented in the text by N. A. Fuchs, "The Mechanics of Aerosols", Macmillan, New York, 1964, pp 102–103, that an electrostatically charged aerosol cloud will expand continuously while retaining its general shape. This is due to the mutual repulsion between each of the particles and all other particles in the cloud. If the cloud is in a contained space, a supplementary phenomenon intervenes which further helps the deposition of the aerosol particles over the entire inside surface of the enclosure. In addition to being repelled by each of the other particles, each particle is also attracted by its electrostatic image charge in the surrounding surfaces. Such image charge varies in location and time depending on the conductivity and permittivity of the enclosing walls.

A paper by I. I. Inculet entitled "Electrostatic Charging and Dissipation of Dust Clouds in Enclosed Rooms" and published in the IEEE Transactions on Industry and General Applications, March/April 1971, gives the results of experiments which demonstrate the effectiveness of dissipation of aerosols by electrostatic forces. In U.S. patent application Ser. No. 305,438, filed Sept. 25, 1981, by Ion I. Inculet, and now abandoned, a method and apparatus are described for spraying electrostatic clouds which include different spray materials in distinct portions of the cloud. Such a system would allow the upper portion of a barn to be sprayed with insecticide while the lower portion is sprayed with water.

The spraying apparatus illustrated in the above patent application, however, is particularly suited for spraying clouds outdoors, such as in orchards or other large agricultural areas.

SUMMARY OF THE INVENTION

It is therefore an object of this invention to provide an electrostatic spraying nozzle suitable for spraying one or more materials for deposition on the inner surface of an enclosed area.

These and other objects are achieved in an electrostatic nozzle for spraying liquids which consists of a conduit for receiving a gas to be driven at high speed out of an opening in the conduit, and of one or more airfoils positioned at the conduit opening. The airfoils each have a curved leading edge, and a tapered trailing edge. A channel is located within each airfoil, near the leading edge, for receiving the liquid to be sprayed. Perforations connect one surface of the airfoil to the channel by which the liquid may flow onto the one surface. The nozzle further includes an electrode spaced from the one surface of each of the airfoils. When the electrode is connected to a dc voltage source, the liquid on the one surface of the airfoil is inductively charged. A gas flow deflector is positioned near the trailing edge of each airfoil on the side of the airfoil opposite the one surface. The deflector redirects the gas flow toward the trailing edge of the airfoil to atomize the liquid flowing from the surface.

In accordance with another aspect of this invention, the opening in the conduit is rectangular. The airfoils are elongated and mounted across the width of the opening, and the deflector is an elongated incurved, wedge-shaped member mounted across the width of the opening. The perforations in the one surface of the airfoils are downstream from the widest portion of the airfoil means.

The electrode for each airfoil has a planar surface facing the one surface of the airfoil, and may be spaced from the inner walls of the conduit. In addition, the edges of the opening in the conduit may be tapered.

Many other objects and aspects of the invention will be clear from the detailed description of the drawings.

DETAILED DESCRIPTION

Figures 1, 2, 3, 5, 6:
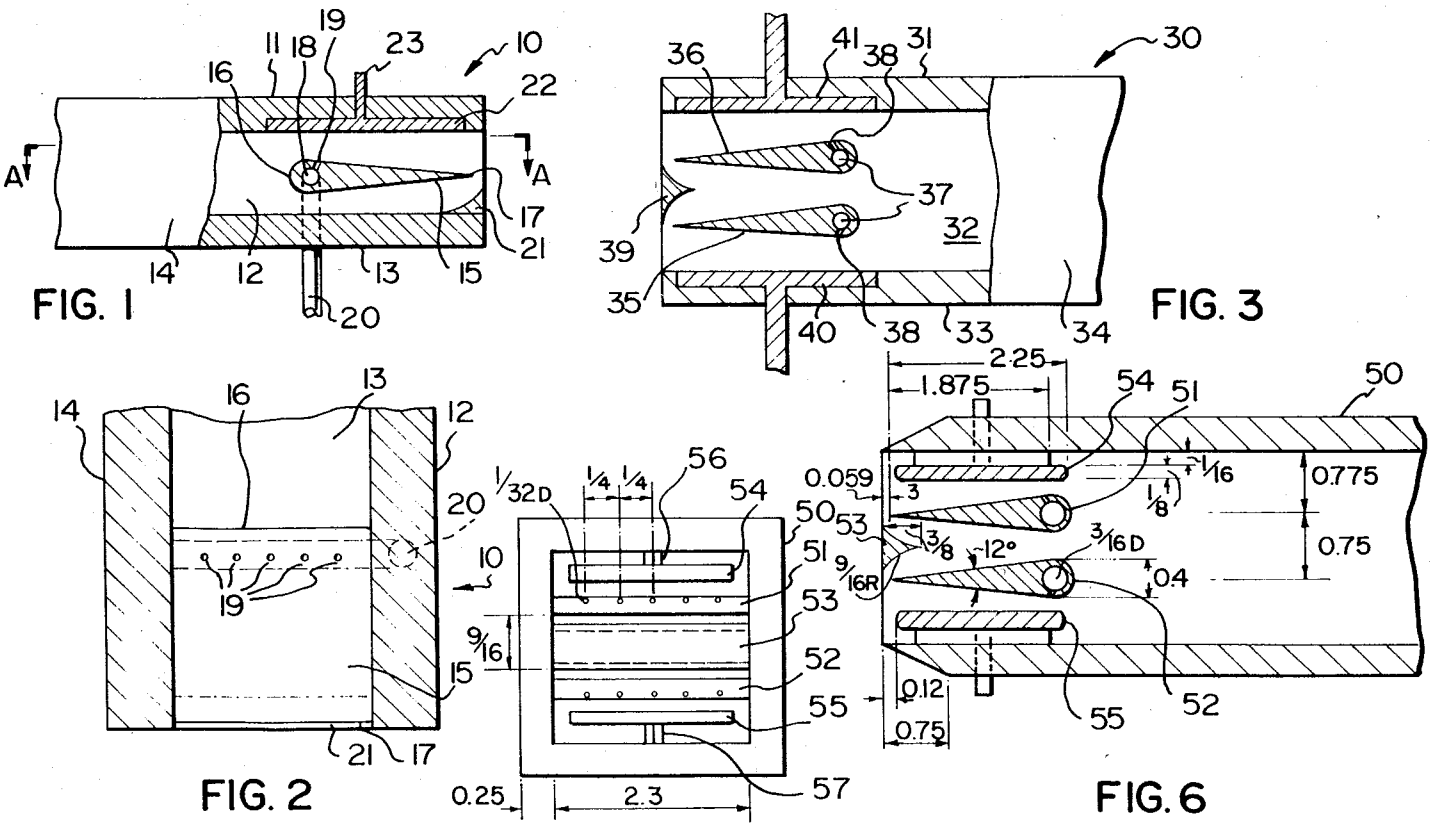
FIGS. 1 and 2 illustrate side and top views of a nozzle in accordance with the present invention.
FIG. 3 illustrates a side view of a dual foil nozzle.
FIGS. 5 and 6 illustrate front and side views of a second embodiment of a dual foil nozzle.

The spraying nozzle, in accordance with the present invention, in its basic form is illustrated in FIGS. 1 and 2. The nozzle includes a hollow conduit 10 through which an appropriate gas, such as air, at a high speed may be driven from left to right in FIG. 1. The conduit 10 is shown to have four walls 11, 12, 13 and 14, each having a planar inner surface for ease of construction. An airfoil shaped member 15 is positioned across the width of the conduit 10. The airfoil member 15 has an aerodynamically curved leading edge 16 upstream in the gas flow and a tapered trailing edge 17 near the opening of the nozzle. The foil 15 includes a channel 18 located within the foil near the leading edge 16 and a number of perforations 19 which lead to the airfoil surface. The liquid to be sprayed is directed into the channel 18 by a tubing 20 which may be located in one of the conduit 10 walls or which may pass directly through the wall. In addition, an incurved deflector 21 is located at the opening of the nozzle. The deflector 21 is located at the trailing edge 17 of the foil 15 and on the side of the foil 15 opposite the perforations 19. All of the components 10, 15 and 21 thus far described may be made from the same non-electrically conducting material, such as plexiglass.

In order to charge the liquid, a planar electrode 22 is mounted facing the foil 15 surface which includes the perforations 19. This electrode 22 with its terminal 23 is electrically conductive and, thus, may be made of copper, brass, or any other conductive material including conductive plastics. If the electrode 22 is made from a material such as conductive plastic, in which the electric resistivity is just sufficient for allowing the replenishment of the electric charges on the electrodes on account of the inevitable leakage over the surface, the electrode would be ideal from a safety point of view. The higher the resistivity of the electrode, the smaller the electric shock in case the electrode is inadvertently touched by the operator.

The nozzle illustrated in FIG. 1 provides an efficient means of spraying a single liquid into an enclosed area. If it is desired to spray two or more separate liquids, two or more such nozzles may be used together with the spray from each being directed towards a different area.

On the other hand, in enclosed areas such as barns where it is desired to spray the insecticide over the upper half of the barn only and a non-active liquid such as water in the lower half, the nozzle illustrated in FIG. 3 is preferred.

This nozzle includes a conduit 30 with inner planar walls 31, 32, 33 and 34 through which air at high velocity is driven. At the end of conduit 30, two airfoils 35, 36 are spaced from one another. The airfoils are of the type described with respect to FIG. 1, each foil 35, 36, having a channel 37 running the width of the foil with perforations 38 allowing the liquid from the channel 37 to flow onto the surface of the foil 35, 36. The perforations 38 are located on the sides of the foils which are opposite the sides facing one another. A wedge-shaped, incurved deflector 39 is mounted between the foil 35, 36, trailing edges across the width of the conduit 30 opening. Once again, the conduit 30, the foils 35, 36, and the deflector 39 are made from a non-electrically conducting material, such as plexiglass. A pair of electrodes 40, 41, are mounted in walls 31, 33, facing the surfaces of foils 35, 36. The electrodes 40, 41, which may be rectangular or square, and their terminals would be made of electrically conductive material.

Figure 4:
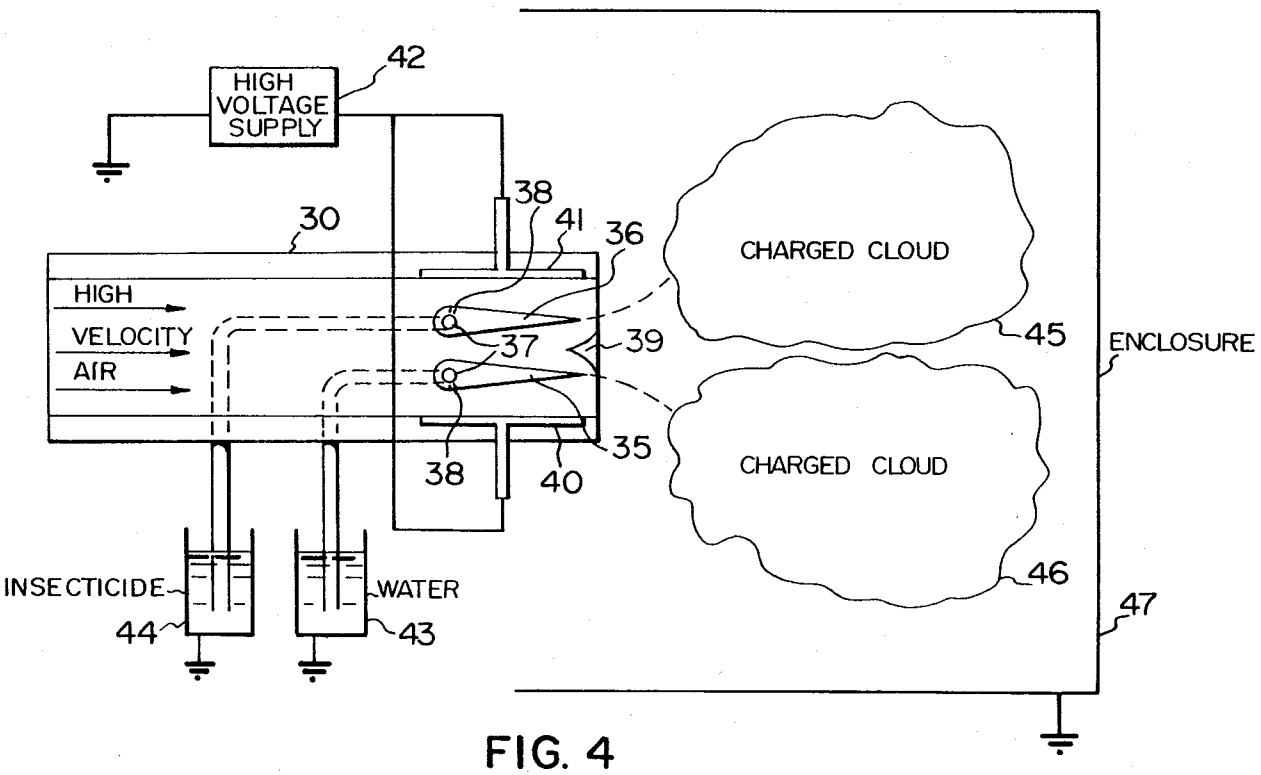
FIG. 4 illustrates the operation of a dual foil nozzle.

FIG. 4 illustrates the operation of a nozzle in accordance with the present invention. The nozzle shown in FIG. 3 being used for illustrative purposes.

An appropriate gas, such as air, is driven through the conduit 30 in the direction shown by the arrows. The airfoils 35, 36 cause constrictions to be formed in the conduit 30. This creates localized low pressure zones downstream of the leading edges of the foils. The deflector 39 between the foils separates and redirects the airflow from between the foils such that cross-currents are formed at the trailing edges of the foils 35, 36. Channels 37 in foils 35 and 36 are connected to a water supply 43 and an insecticide supply 44, respectively. The liquid from these supplies may be pumped up or gravity fed to channels 37, however, it has been found that the localized low pressure zones in the area of the perforations 38 will draw the liquid from the channel up the feed perforations 38. The air flow along the surface of the foils 35, 36 will carry the liquid, insecticide or water to the trailing edge of the foils. The shape of the foil is such that boundary layer separation is avoided, so that the air flow along the surface is laminar.

The cross-currents created at the trailing edge of the foils atomizes the liquid by breaking droplets right off at the edge of the foil. Uniform droplets of a few micrometer diameter size are thus produced.

Electrically, the electrodes 40 and 41 are both connected to the same positive or negative pole of a high voltage dc supply 42. Voltage levels of 6 kV have been found to be adequate. The liquid facing the electrodes will become inductively charged to a polarity opposite that of electrodes 40, 41. To assure proper charging of the liquid, the supplies 43 and 44 should also be properly grounded.

As illustrated in FIG. 4, the droplets from the upper foil 36 are directed upward and will form a charged cloud 45 of insecticide which tends to be deposited on the upper half of the enclosure 46 by the attraction of the walls of the enclosure which are substantially grounded, and by a repulsing force created by the other cloud 46 which is charged to the same polarity. The lower cloud is formed by droplets created by foil 35, and for the same reasons will tend to be deposited on the lower half of the enclosure 47. In this instance, the lower cloud 46 is formed by water droplets and thus in a barn environment, the bedding, feed and cattle will receive very little insecticide contamination.

For spraying in barns with an insecticide upper cloud, it would be preferred to charge the clouds negatively by connecting the electrodes 40, 41, to the positive pole of the supply 42. The atmospheric electric field is generally positive directed downwards. By charging the insecticide cloud negatively, some additional upward force may be present due to the external electric field. However, by and large these external fields are very small, i.e. in the order of a hundred volts per meter, and as such most of the time will be insignificant.

A further dual airfoil nozzle in accordance with the present invention is illustrated in FIGS. 5 and 6 with one example of dimensions being shown in inches. The nozzle includes an air conduit 50 with a pair of airfoils 51, 52 and an incurved, wedge-shaped deflector 53 mounted at the outlet as in the previous embodiment. In this embodiment, however, the electrodes 54 and 55 are spaced from the inside walls of the conduit 50 by mounts 56 and 57, respectively. The spacing of the electrodes from the walls keeps the electrodes dry by placing them in the airstream and increases the surface path lengths to ground, thus decreasing or eliminating leakage of electric current from the electrodes. In addition, the outside edges of the conduit 50 are tapered back. This prevents turbulence at the mouth of the nozzle which can cause liquid residue to accumulate and drip from the nozzle. The sprayer parameters for the above nozzle are the following:

Air discharge: 11 $m^3$/min
Air velocity: 100 m/s
Liquid flow rate: 13 ml/s maximum
Changing current: 5.3 $\mu$A at 6 kV
Charge/mass ratio: 0.41 $\mu$C/g Many modifications in the above described embodiments of the invention can be carried out without departing from the scope thereof and, therefore, the scope of the present invention is intended to be limited only by the appended claims.

We claim:

1. An electrode nozzle for spraying liquid comprising:

conduit means for receiving a gas to be driven at high speed out of an opening defined by edges in the conduit means;

one or more airfoil means positioned at the conduit opening, the airfoil means having a curved leading edge, a tapered trailing edge, channel means within the airfoil means near the leading edge for receiving the liquid to be sprayed and perforations through one surface of the airfoil means to the channel means for directing the liquid onto the one surface;

electrode means spaced from the one surface of the airfoil means for connection to a dc voltage source to inductively charge the liquid on the one surface of the airfoil means; and deflector means positioned near the trailing edge of the airfoil on the side of the airfoil opposite the one surface, for redirecting gas flow toward the trailing edge to atomize the liquid from the channel means.

2. A nozzle as claimed in claim 1 wherein the perforations in the one surface of the airfoil means are downstream from the widest portion of the airfoil means.

3. A nozzle as claimed in claim 2 wherein the opening in the conduit means is rectangular, the airfoil means is elongated and mounted across the width of the opening.

4. A nozzle as claimed in claim 3 wherein the deflector means is an elongated, incurved, wedge-shaped member mounted across the width of the opening.

5. A nozzle as claimed in claim 4 wherein the electrode means includes a planar surface facing the one surface of the airfoil means.

6. A nozzle as claimed in claim 5 wherein the electrode means is spaced from the inner walls of the conduit means.

7. A nozzle as claimed in claim 6 wherein the edges of the opening in the conduit are tapered on outer surfaces of the conduit means.

8. An electrode nozzle for spraying liquids comprising:

a conduit means for receiving a gas to be driven at high speed out of an opening defined by edges in the conduit means;

first and second airfoil means positioned at the conduit opening, each airfoil means having a curved leading edge, a tapered trailing edge, channel means within each airfoil means near the leading edge for receiving a liquid to be sprayed and perforations through one surface of the airfoil means to the channel means for directing the liquid from the channel means onto the one surface;

first electrode means spaced from the one surface of the first airfoil means and second electrode means spaced from the one surface of the second airfoil means, for connection to a voltage source to inductively charge the liquids on the surfaces of the airfoil means; and deflector means positioned near the trailing edge of each airfoil means on the side of the airfoil opposite the surfaces, for redirecting gas flow toward the trailing edges of the airfoil means to atomize the liquids from the channel means.

9. A nozzle as claimed in claim 8 wherein the opening in the conduit means is rectangular and the airfoil means is elongated and mounted across the width of the opening.

10. A nozzle as claimed in claim 9 wherein the obstruction deflector means is an elongated, incurved wedge-shaped member mounted across the width of the opening.

11. A nozzle as claimed in claim 10 wherein the wedge-shaped member is mounted between the first and second airfoil means.

12. A nozzle as claimed in claim 8 wherein the perforations in the one surface of each of the airfoil means are downstream the widest portion of the airfoil means.

13. A nozzle as claimed in claim 8 wherein each electrode means includes a planar surface facing the one surface of each airfoil means.

14. A nozzle as claimed in claim 12 wherein the electrode means is spaced from the inner walls of the conduit means.

15. A nozzle as claimed in claim 8 wherein the edges of the opening in the conduit means are tapered on outer surfaces of the conduit means.

* * * * *